US011257411B2

(12) United States Patent
Xue et al.

(10) Patent No.: US 11,257,411 B2
(45) Date of Patent: Feb. 22, 2022

(54) GATE DRIVER ON ARRAY (GOA) CIRCUIT AND DISPLAY PANEL

(71) Applicant: Shenzhen China Star Optoelectronics Semiconductor Display Technology Co., Ltd., Shenzhen (CN)

(72) Inventors: Yan Xue, Shenzhen (CN); Xian Wang, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 176 days.

(21) Appl. No.: 16/757,840

(22) PCT Filed: Mar. 24, 2020

(86) PCT No.: PCT/CN2020/080776

§ 371 (c)(1),
(2) Date: Apr. 21, 2020

(87) PCT Pub. No.: WO2021/168952

PCT Pub. Date: Sep. 2, 2021

(65) Prior Publication Data

US 2022/0028316 A1 Jan. 27, 2022

(30) Foreign Application Priority Data

Feb. 26, 2020 (CN) ..... 202010120329.7

(51) Int. Cl.
*G09G 3/20* (2006.01)

(52) U.S. Cl.
CPC ..... *G09G 3/20* (2013.01); *G09G 2300/0408* (2013.01); *G09G 2300/0876* (2013.01); *G09G 2310/08* (2013.01)

(58) Field of Classification Search
CPC ... G09G 2310/0286; G09G 2300/0809; G09G 3/3648; G09G 2310/0251; G09G 2310/0267; G09G 3/3266
See application file for complete search history.

(56) References Cited

U.S. PATENT DOCUMENTS

2014/0002163 A1* 1/2014 Jang ..... H04L 25/0272 327/231
2016/0284304 A1* 9/2016 Dai ..... G09G 3/3677
2018/0190223 A1* 7/2018 Zeng ..... G09G 3/3674
(Continued)

FOREIGN PATENT DOCUMENTS

CN 108831398 11/2018
CN 109448656 3/2019
(Continued)

*Primary Examiner* — Gerald Johnson

(57) ABSTRACT

The present invention provides a gate driver on array (GOA) circuit and a display panel, in the GOA circuit, a nth one of GOA units has a pull-up control module, a logical addressing module, a pull-up module, first pull-down module, a second pull-down module, a first pull-down maintenance module connected to a first node, a second pull-down module, a third pull-down module, and a second pull-down maintenance module connected to a third node, and a logical addressing module. The logical addressing module pulls up a potential of a second node potential twice to facilitate increasing a threshold voltage margin.

20 Claims, 7 Drawing Sheets

(56) References Cited

U.S. PATENT DOCUMENTS

| | | | | |
|---|---|---|---|---|
| 2018/0336835 | A1* | 11/2018 | Liu | G09G 3/3677 |
| 2020/0135287 | A1* | 4/2020 | Han | G09G 3/3266 |

FOREIGN PATENT DOCUMENTS

| | | |
|---|---|---|
| CN | 109935209 | 6/2019 |
| KR | 2018-0039196 | 4/2018 |
| KR | 2018-0042754 | 4/2018 |

* cited by examiner

GATE DRIVER ON ARRAY (GOA) CIRCUIT AND DISPLAY PANEL

RELATED APPLICATIONS

This application is a National Phase of PCT Patent Application No. PCT/CN2020/080776 having International filing date of Mar. 24, 2020, which claims the benefit of priority of Chinese Patent Application No. 202010120329.7 filed on Feb. 26, 2020. The contents of the above applications are all incorporated by reference as if fully set forth herein in their entirety.

FIELD AND BACKGROUND OF THE INVENTION

The present invention relates to a field of display technologies, especially relates to a gate driver on array (GOA) circuit and a display panel.

A conventional real-time compensation gate driver on array (GOA) circuit structure is as shown in FIG. 1. The GOA circuit comprises transistors Ta, Tb, Tc, T1, T1A, T1B, T1C, T3, T3A, T3 nA, T3*n*B, T3*n*C, T3*n*, T3*q*, T4, T4*l*, T4*q*, T5, T5A, T5B, T5*q*, T6, T6*cr*, T7, T7*cr*, T8, T9 and storage capacitors Cm1, Cm2, Cm3. A connection way for each transistor is as shown in FIG. 1, the GOA circuit also comprises a first node Q, a second node M, a third node Qb, a fifth node Mh, and a sixth node Qh. C(n−3), C(n+3), COUNT(n) are stage transmission signals. CRCLK, SCCLK, and SECLK are timing signals. LSP and VST are input signals of the GOA circuit. SCOUNT(n) and SEOUT (n) are output signals of the GOA circuit. GVDD is a power high potential signal. GVSS0, GVSS1, and GVSS2 are power low potential signals. G-RESET is a reset signal.

COUNT(n), SCOUNT(n), and SEOUT(n) are driver signals provided to scan lines in the display panel to guarantee that the scan lines in the display panel can receive the driver signals to switch on the transistors controlled thereby respectively. It is necessary to assure that output of the COUNT(n), SCOUNT(n), and SEOUT(n) is normal. Because gate electrodes of T6, T6*cr*, and T8 are connected to the first node Q, output of each output signal is controlled by the first node Q. Sufficiency or insufficiency of a charge rate of the Q point is controlled by a of a second node M. In a display time period, when a LSP and the C(n−3) is in a high potential, the Ta and the Tb switch on, a potential of the second node M is high. When the G-RESET is in a high potential in a blank time period, the T1B and the T1C switch on. When the first node Q is pulled up by the potential of the second node M to make the CRCLK, the SCCLK, and the SECLK in a high potential, the T6, the T6*cr*, and the T8 switch on, the COUNT(n), the SCOUNT(n), and the SEOUT(n) of a high potential are outputted to the scan lines. As such, a value of the potential of first node Q is of paramount importance to normal output of the output signal. Under normal circumstances, the first node Q is able to control normal output of the output signal. However, when a threshold voltage margin shifts positively in the GOA circuit, the Q point requires a higher potential to ensure the normal output of the COUNT(n), the SCOUNT(n), and the SEOUT(n). To guarantee the normal output of the GOA circuit, the threshold voltage margin available for the GOA circuit needs to decrease.

However, the conventional GOA circuit is a real-time compensation circuit and is structurally complicated such that when an available threshold voltage margin (Vth margin) of the GOA circuit is less, an extremely stable transistor process is required and accordingly difficulty of development of the transistor process is high.

Therefore, a technical issue of difficulty of development of a transistor process in the conventional GOA circuit needs to be solved.

SUMMARY OF THE INVENTION

Technical Issue

The present invention provides a gate driver on array (GOA) circuit and a display panel to mitigate the technical issue of difficulty of development of a transistor process in the conventional GOA circuit.

Technical Solution

To solve the issue, the present invention provides technical solutions as follows:

The present invention provides a GOA circuit comprising a number "m" of GOA units connected in cascade, wherein a nth one of the GOA units comprises:

a pull-up control module connected to a first node and configured to pull up a potential of the first node in a display time period;

a logical addressing module comprising a second node, connected to the first node, and configured to pull up a potential of the second node twice in the display time period and to pull up the potential of the first node through the second node in a blank time period;

a pull-up module connected to the first node, configured to pull up a potential of a $n^{th}$ stage transmission signal, a potential of a first output signal, and a potential of a second output signal;

a first pull-down module connected to the first node, and configured to pull down the potential of the first node in the blank time period;

a second pull-down module connected to the first node and a third node and configured to pull down the potential of the first node and a potential of the third node in the display time period;

a third pull-down module connected to the third node and the second pull-down module and configured to pull down the potential of the third node in the blank time period;

a first pull-down maintenance module comprising the third node, connected to the first node and the first pull-down module, and configured to keep the potential of the first node low; and a second pull-down maintenance module connected to the third node and the pull-up module and configured to keep the potential of the $n^{th}$ stage transmission signal, the potential of the first output signal, and the potential of the second output signal low.

In the GOA circuit of the present invention, the pull-up control module comprises a first transistor and a second transistor, a gate electrode and a first electrode of the first transistor and a gate electrode of the second transistor are connected to a $(n-2)^{th}$ stage transmission signal, a second electrode of the first transistor is connected to a first electrode of the second transistor and a fourth node, and a second electrode of the second transistor is connected to the first node.

In the GOA circuit of the present invention, the logical addressing module comprises a third transistor, a fourth transistor, a fifth transistor, a sixth transistor, a seventh transistor, an eighth transistor, a ninth transistor, and a first storage capacitor, a gate electrode of the third transistor is connected to the $(n-2)^{th}$ stage transmission signal, a first electrode of the third transistor is connected to a first low potential signal, a second electrode of the third transistor is connected to a first electrode of the fourth transistor, a gate electrode and a second electrode of the fourth transistor are connected to a high potential signal, a gate electrode of the fifth transistor is connected to a first input signal, a first electrode of the fifth transistor is connected to the $(n-2)^{th}$ stage transmission signal, a second electrode of the fifth transistor is connected to a first electrode of the sixth transistor and a first electrode of the seventh transistor, a gate electrode of the sixth transistor is connected to the first input signal, a second electrode of the sixth transistor and a gate electrode of the seventh transistor are connected to the second node, a second electrode of the seventh transistor is connected to the high potential signal, a gate electrode of the eighth transistor is connected to the second node, a first electrode of the eighth transistor is connected to the high potential signal, a second electrode of the eighth transistor is connected to a first electrode of the ninth transistor, a gate electrode of the ninth transistor is connected to a reset signal, a second electrode of the ninth transistor is connected to the first node, a first electrode plate of the first storage capacitor is connected to the second electrode of the third transistor, and a second electrode plate of the first storage capacitor is connected to the second node.

In the GOA circuit of the present invention, the pull-up module comprises a tenth transistor, an eleventh transistor, a twelfth transistor, a thirteenth transistor, a second storage capacitor, and a third storage capacitor, a gate electrode of the tenth transistor, a gate electrode of the eleventh transistor, and a gate electrode of the twelfth transistor are connected to the first node, a first electrode of the tenth transistor is connected to a first clock signal, a second electrode of the tenth transistor is connected to the $n^{th}$ stage transmission signal, a first electrode of the eleventh transistor is connected to a second clock signal, a second electrode of the eleventh transistor is connected to the first output signal, a first electrode of the twelfth transistor is connected to a third clock signal, a second electrode of the twelfth transistor is connected to the second output signal, a gate electrode of the thirteenth transistor is connected to the first node, a first electrode of the thirteenth transistor is connected to the fourth node, a second electrode of the thirteenth transistor is connected to the first output signal, a first electrode plate of the second storage capacitor is connected to the first node, a second electrode plate of the second storage capacitor is connected to the first output signal, a first electrode plate of the third storage capacitor is connected to the first node, and a second electrode plate of the third storage capacitor is connected to the second output signal.

In the GOA circuit of the present invention, the first pull-down module comprises a fourteenth transistor and a fifteenth transistor, a gate electrode of the fourteenth transistor and a gate electrode of the fifteenth transistor are connected to a second input signal, a first electrode of the fourteenth transistor is connected to the first node, a second electrode of the fourteenth transistor is connected to a first electrode of the fifteenth transistor and the fourth node, and a second electrode of the fifteenth transistor is connected to the first low potential signal.

In the GOA circuit of the present invention, the second pull-down module comprises a sixteenth transistor, a seventeenth transistor, and an eighteenth transistor, a gate electrode of the sixteenth transistor and a gate electrode of the seventeenth transistor are connected to a $(n+2)^{th}$ stage transmission signal, a first electrode of the sixteenth transistor is connected to the first node, a second electrode of the sixteenth transistor is connected to a first electrode of the seventeenth transistor and the fourth node, a second electrode of the seventeenth transistor is connected to the first low potential signal, a gate electrode of the eighteenth transistor is connected to the $(n-2)^{th}$ stage transmission signal, a first electrode of the eighteenth transistor is connected to the second low potential signal, and the first electrode of the eighteenth transistor is connected to the third node.

In the GOA circuit of the present invention, the third pull-down module comprises a nineteenth transistor and a twenty transistor, a gate electrode of the nineteenth transistor is connected to the second node, a first electrode of the nineteenth transistor is connected to the second low potential signal, a second electrode of the nineteenth transistor is connected to the twenty transistor first electrode, a gate electrode of the twenty transistor is connected to the reset signal, and a second electrode of the twenty transistor is connected to the third node.

In the GOA circuit of the present invention, the first pull-down maintenance module comprises a twenty-first transistor, a twenty-second transistor, a twenty-third transistor, a twenty-fourth transistor, a twenty-fifth transistor, and a twenty-sixth transistor, a gate electrode of the twenty-first transistor and a gate electrode of the twenty-second transistor are connected to the third node, a first electrode of the twenty-first transistor is connected to the first node, a second electrode of the twenty-first transistor is connected to a first electrode of the twenty-second transistor and the fourth node, a second electrode of the twenty-second transistor is connected to the first low potential signal, a gate electrode and a first electrode of the twenty-third transistor are connected to the high potential signal, a second electrode of the twenty-third transistor is connected to a first electrode of the twenty-fourth transistor, a gate electrode of the twenty-fourth transistor is connected to the first node, a second electrode of the twenty-fourth transistor is connected to the second low potential signal, a gate electrode of the twenty-fifth transistor is connected to a second electrode of the twenty-third transistor, a first electrode of the twenty-fifth transistor is connected to the high potential signal, a second electrode of the twenty-fifth transistor is connected to a first electrode of the twenty-sixth transistor and the third node, a gate electrode of the twenty-sixth transistor is connected to the first node, and a second electrode of the twenty-sixth transistor is connected to the second low potential signal.

In the GOA circuit of the present invention, the second pull-down maintenance module comprises a twenty-seventh transistor, a twenty-eighth transistor, and a twenty-ninth transistor, a gate electrode of the twenty-seventh transistor, a gate electrode of the twenty-eighth transistor, and a gate electrode of the twenty-ninth transistor are connected to the third node, a first electrode of the twenty-seventh transistor is connected to the first low potential signal, a second electrode of the twenty-seventh transistor is connected to the $n^{th}$ stage transmission signal, a first electrode of the twenty-eighth transistor is connected to a third low potential signal, a second electrode of the twenty-eighth transistor is connected to the first output signal, a first electrode of the twenty-ninth transistor is connected to the third low potential signal, and a second electrode of the twenty-ninth transistor is connected to the second output signal.

In the GOA circuit of the present invention, the first input signal, the second input signal and the reset signal are provided by an external timer.

The present invention provides a display panel, comprising a gate driver on array (GOA) circuit, the GOA circuit comprising a number "m" of GOA units connected in cascade, wherein a nth one of the GOA units comprises:

a pull-up control module connected to a first node and configured to pull up a potential of the first node in a display time period;

a logical addressing module comprising a second node, connected to the first node, and configured to pull up a potential of the second node twice in the display time period and to pull up the potential of the first node through the second node in a blank time period;

a pull-up module connected to the first node, configured to pull up a potential of a $n^{th}$ stage transmission signal, a potential of a first output signal, and a potential of a second output signal;

a first pull-down module connected to the first node, and configured to pull down the potential of the first node in the blank time period;

a second pull-down module connected to the first node and a third node and configured to pull down the potential of the first node and a potential of the third node in the display time period;

a third pull-down module connected to the third node and the second pull-down module, and configured to pull down the potential of the third node in the blank time period;

a first pull-down maintenance module comprising the third node, connected to the first node and the first pull-down module, and configured to keep the potential of the first node low; and a second pull-down maintenance module connected to the third node and the pull-up module and configured to keep the potential of the $n^{th}$ stage transmission signal, the potential of the first output signal, and the potential of the second output signal low.

In the display panel of the present invention, the pull-up control module comprises a first transistor and a second transistor, a gate electrode and a first electrode of the first transistor and a gate electrode of the second transistor are connected to a $(n-2)^{th}$ stage transmission signal, a second electrode of the first transistor is connected to a first electrode of the second transistor and a fourth node, and a second electrode of the second transistor is connected to the first node.

In the display panel of the present invention, the logical addressing module comprises a third transistor, a fourth transistor, a fifth transistor, a sixth transistor, a seventh transistor, an eighth transistor, a ninth transistor, and a first storage capacitor, a gate electrode of the third transistor is connected to the $(n-2)^{th}$ stage transmission signal, a first electrode of the third transistor is connected to a first low potential signal, a second electrode of the third transistor is connected to a first electrode of the fourth transistor, a gate electrode and a second electrode of the fourth transistor are connected to a high potential signal, a gate electrode of the fifth transistor is connected to a first input signal, a first electrode of the fifth transistor is connected to the $(n-2)^{th}$ stage transmission signal, a second electrode of the fifth transistor is connected to a first electrode of the sixth transistor and a first electrode of the seventh transistor, a gate electrode of the sixth transistor is connected to the first input signal, a second electrode of the sixth transistor and a gate electrode of the seventh transistor are connected to the second node, a second electrode of the seventh transistor is connected to the high potential signal, a gate electrode of the eighth transistor is connected to the second node, a first electrode of the eighth transistor is connected to the high potential signal, a second electrode of the eighth transistor is connected to a first electrode of the ninth transistor, a gate electrode of the ninth transistor is connected to a reset signal, a second electrode of the ninth transistor is connected to the first node, a first electrode plate of the first storage capacitor is connected to the second electrode of the third transistor, and a second electrode plate of the first storage capacitor is connected to the second node.

In the display panel of the present invention, the pull-up module comprises a tenth transistor, an eleventh transistor, a twelfth transistor, a thirteenth transistor, a second storage capacitor, and a third storage capacitor, a gate electrode of the tenth transistor, a gate electrode of the eleventh transistor, and a gate electrode of the twelfth transistor are connected to the first node, a first electrode of the tenth transistor is connected to a first clock signal, a second electrode of the tenth transistor is connected to the $n^{th}$ stage transmission signal, a first electrode of the eleventh transistor is connected to a second clock signal, a second electrode of the eleventh transistor is connected to the first output signal, a first electrode of the twelfth transistor is connected to a third clock signal, a second electrode of the twelfth transistor is connected to the second output signal, a gate electrode of the thirteenth transistor is connected to the first node, a first electrode of the thirteenth transistor is connected to the fourth node, a second electrode of the thirteenth transistor is connected to the first output signal, a first electrode plate of the second storage capacitor is connected to the first node, a second electrode plate of the second storage capacitor is connected to the first output signal, a first electrode plate of the third storage capacitor is connected to the first node, and a second electrode plate of the third storage capacitor is connected to the second output signal.

In the display panel of the present invention, the first pull-down module comprises a fourteenth transistor and a fifteenth transistor, a gate electrode of the fourteenth transistor and a gate electrode of the fifteenth transistor are connected to a second input signal, a first electrode of the fourteenth transistor is connected to the first node, a second electrode of the fourteenth transistor is connected to a first electrode of the fifteenth transistor and the fourth node, and a second electrode of the fifteenth transistor is connected to the first low potential signal.

In the display panel of the present invention, the second pull-down module comprises a sixteenth transistor, a seventeenth transistor, and an eighteenth transistor, a gate electrode of the sixteenth transistor and a gate electrode of the seventeenth transistor are connected to a $(n+2)^{th}$ stage transmission signal, a first electrode of the sixteenth transistor is connected to the first node, a second electrode of the sixteenth transistor is connected to a first electrode of the seventeenth transistor and the fourth node, a second electrode of the seventeenth transistor is connected to the first low potential signal, a gate electrode of the eighteenth transistor is connected to the $(n-2)^{th}$ stage transmission signal, a first electrode of the eighteenth transistor is connected to the second low potential signal, and the first electrode of the eighteenth transistor is connected to the third node.

In the display panel of the present invention, the third pull-down module comprises a nineteenth transistor and a twenty transistor, a gate electrode of the nineteenth transistor is connected to the second node, a first electrode of the nineteenth transistor is connected to the second low potential signal, a second electrode of the nineteenth transistor is connected to the twenty transistor first electrode, a gate electrode of the twenty transistor is connected to the reset signal, and a second electrode of the twenty transistor is connected to the third node.

In the display panel of the present invention, the first pull-down maintenance module comprises a twenty-first transistor, a twenty-second transistor, a twenty-third transistor, a twenty-fourth transistor, a twenty-fifth transistor, and a twenty-sixth transistor, a gate electrode of the twenty-first transistor and a gate electrode of the twenty-second transistor are connected to the third node, a first electrode of the twenty-first transistor is connected to the first node, a second electrode of the twenty-first transistor is connected to a first electrode of the twenty-second transistor and the fourth node, a second electrode of the twenty-second transistor is connected to the first low potential signal, a gate electrode and a first electrode of the twenty-third transistor are connected to the high potential signal, a second electrode of the twenty-third transistor is connected to a first electrode of the twenty-fourth transistor, a gate electrode of the twenty-fourth transistor is connected to the first node, a second electrode of the twenty-fourth transistor is connected to the second low potential signal, a gate electrode of the twenty-fifth transistor is connected to a second electrode of the twenty-third transistor, a first electrode of the twenty-fifth transistor is connected to the high potential signal, a second electrode of the twenty-fifth transistor is connected to a first electrode of the twenty-sixth transistor and the third node, a gate electrode of the twenty-sixth transistor is connected to the first node, and a second electrode of the twenty-sixth transistor is connected to the second low potential signal.

In the display panel of the present invention, the second pull-down maintenance module comprises a twenty-seventh transistor, a twenty-eighth transistor, and a twenty-ninth transistor, a gate electrode of the twenty-seventh transistor, a gate electrode of the twenty-eighth transistor, and a gate electrode of the twenty-ninth transistor are connected to the third node, a first electrode of the twenty-seventh transistor is connected to the first low potential signal, a second electrode of the twenty-seventh transistor is connected to the $n^{th}$ stage transmission signal, a first electrode of the twenty-eighth transistor is connected to a third low potential signal, a second electrode of the twenty-eighth transistor is connected to the first output signal, a first electrode of the twenty-ninth transistor is connected to the third low potential signal, and a second electrode of the twenty-ninth transistor is connected to the second output signal.

In the display panel of the present invention, the first input signal, the second input signal and the reset signal are provided by an external timer.

Advantages

Advantages of the present invention are as follows: The present invention provides the GOA circuit and the display panel, the GOA circuit comprises a number "m" of GOA units connected in cascade. A nth one of the GOA units comprises a pull-up control module, a logical addressing module, a pull-up module, a first pull-down module, a second pull-down module, a third pull-down module, a first pull-down maintenance module, and a second pull-down maintenance module. The pull-up control module is connected to a first node and is configured to pull up a potential of the first node in a display time period. The logical addressing module comprises a second node, the logical addressing module is connected to the first node, is configured to, pull up the second node potential twice in the display time period, and is configured to pull up the potential of the first node through the second node in a blank time period. The pull-up module is connected to the first node and is configured to pull up a potential of a $n^{th}$ stage transmission signal, a potential of a first output signal, and a potential of a second output signal. The first pull-down module is connected to the first node and is configured to pull down the potential of the first node in the blank time period. The second pull-down module is connected to the first node and a third node and is configured to pull down the potential of the first node and a potential of the third node in the display time period. The third pull-down module is connected to the third node and the second pull-down module and is configured to pull down the potential of the third node in the blank time period. The first pull-down maintenance module comprises the third node, is connected to the first node and the first pull-down module, and is configured to keep the potential of the first node low. The second pull-down maintenance module is connected to the third node and the pull-up module and is configured to keep the potential of the $n^{th}$ stage transmission signal, the potential of the first output signal, and the potential of the second output signal low. By pulling up the potential of the second node twice in the display time period, the potential of the first node is increased in the blank time period and a charge rate is guaranteed such that a margin of a threshold voltage available for the GOA circuit to improve stability of the GOA circuit and lower developing difficulty for a transistor process.

BRIEF DESCRIPTION OF THE SEVERAL VIEWS OF THE DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may acquire other figures according to the appended figures without any creative effort.

DESCRIPTION OF SPECIFIC EMBODIMENTS OF THE INVENTION

Figure 1:
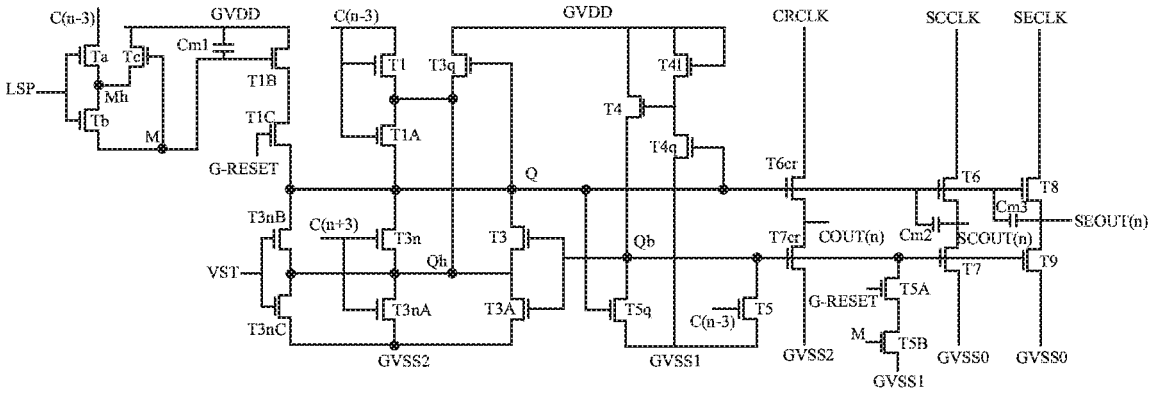
FIG. 1 is a schematic structural view of a conventional GOA circuit.

Each of the following embodiments is described with appending figures to illustrate specific embodiments of the present invention that are applicable. The terminologies of direction mentioned in the present invention, such as "upper", "lower", "front", "rear", "left", "right", "inner", "outer", "side surface", etc., only refer to the directions of the appended figures. Therefore, the terminologies of direction are used for explanation and comprehension of the present invention, instead of limiting the present invention. In the figures, units with similar structures are marked with the same reference characters.

The present invention provides a gate driver on array (GOA) circuit and a display panel to mitigate the technical issue of difficulty of development of a transistor process in the conventional GOA circuit.

Figure 2:
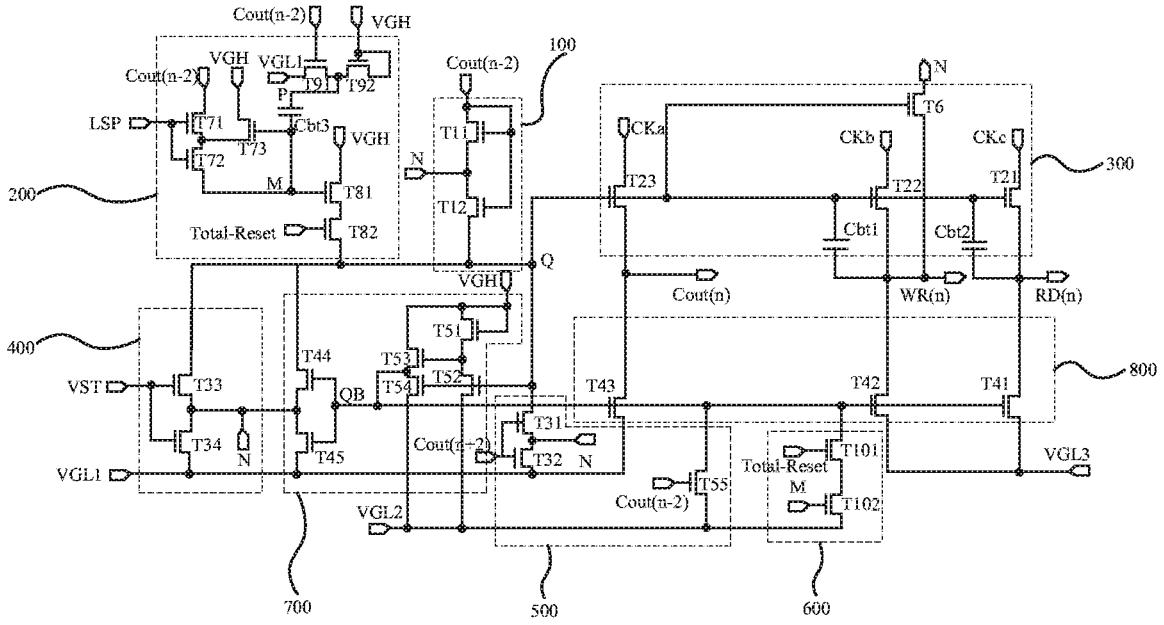
FIG. 2 is a schematic structural view of a gate driver on array (GOA) circuit provided by an embodiment of the present invention.

With reference to FIG. 2, FIG. 2 is a schematic structural view of a gate driver on array (GOA) circuit provided by an embodiment of the present invention. The GOA circuit comprises a number "m" of GOA units connected in cascade. A nth one of the GOA units comprises a pull-up control module 100, a logical addressing module 200, a pull-up module 300, a first pull-down module 400, a second pull-down module 500, a third pull-down module 600, a first pull-down maintenance module 700, and a second pull-down maintenance module 800.

The pull-up control module 100 is connected to a first node Q, and is configured to pull up a potential of the first node Q in a display time period.

The logical addressing module 200 comprises a second node M, is connected to the first node, is configured to pull up a potential of the second node in the display time period twice, and is configured to pull up the potential of the first node through the second node in a blank time period.

The pull-up module 300 is connected to the first node Q, and is configured to pull up a potential of a $n^{th}$ stage transmission signal Count(n), a potential of a first output signal WR(n), and a potential of a second output signal RD(n).

The first pull-down module 400 is connected to the first node Q and is configured to pull down the potential of the first node Q in the blank time period.

The second pull-down module 500 is connected to the first node Q and a third node QB and is configured to pull down the potential of the first node Q and a potential of the third node QB in the display time period.

The third pull-down module 600 is connected to the third node QB and the second pull-down module 500 and is configured to pull down the potential of the third node QB in the blank time period.

The first pull-down maintenance module 700 comprises the third node QB, the first pull-down maintenance module 700 is connected to the first node Q and the first pull-down module 400 and is configured to keep the potential of the first node Q low.

The second pull-down maintenance module 800 is connected to the third node QB and the pull-up module 300 and is configured to keep the potential of the $n^{th}$ stage transmission signal Count(n), the potential of the first output signal WR(n), and the potential of the second output signal RD(n) low.

The display panel when displaying images needs to pass through the display time period Programming and the blank time period Blank. The display time period is a real display time period of each image frame, and the blank time period a time period of a real display time between adjacent two image frames.

In the present invention, by pulling up the potential of the second node M in the display time period twice, a charge rate of the first node Q in the blank time period is guaranteed such that a margin of a threshold voltage available for the GOA circuit to improve stability of the GOA circuit and lower developing difficulty for a transistor process.

With reference to FIG. 2, the pull-up control module 100 comprises a first transistor T11 and a second transistor T12. A gate electrode and a first electrode of the first transistor T11 and a gate electrode of the second transistor T12 are connected to a $(n-2)^{th}$ stage transmission signal Count(n−2). A second electrode of the first transistor T11 is connected to a first electrode of the second transistor T12, and a second electrode of the second transistor T12 is connected to the first node Q.

The logical addressing module 200 comprises a third transistor T91, a fourth transistor T92, a fifth transistor T71, a sixth transistor T72, a seventh transistor T73, an eighth transistor T81, a ninth transistor T91, and a first storage capacitor Cbt3. A gate electrode of the third transistor T91 is connected to the $(n-2)^{th}$ stage transmission signal Count (n−2). A first electrode of the third transistor T91 is connected to a first low potential signal VGL1. A second electrode of the third transistor T91 is connected to a first electrode of the fourth transistor T92. A gate electrode and a second electrode of the fourth transistor T92 are connected to a high potential signal VGH. A gate electrode of the fifth transistor T71 is connected to a first input signal LSP. A first electrode of the fifth transistor T71 is connected to the $(n-2)^{th}$ stage transmission signal Count(n−2). A second electrode of the fifth transistor T71 is connected to a first electrode of the sixth transistor T72 and a first electrode of the seventh transistor T73. A gate electrode of the sixth transistor T72 is connected to the first input signal. A second electrode of the sixth transistor T72 is connected to a gate electrode of the seventh transistor T73 are connected to the second node M. A second electrode of the seventh transistor T73 is connected to the high potential signal VGH. A gate electrode of the eighth transistor T81 is connected to the second node M. A first electrode of the eighth transistor T81 is connected to the high potential signal VGH. A second electrode of the eighth transistor T81 is connected to a first electrode of the ninth transistor T91. A gate electrode of the ninth transistor T91 is connected to a reset signal Total-Reset, and a second electrode of the ninth transistor T91 is connected to the first node Q. A first electrode plate of the first storage capacitor Cbt3 is connected to the second electrode of the third transistor T91, and a second electrode plate of the first storage capacitor Cbt3 is connected to the second node M.

The pull-up module 300 comprises a tenth transistor T23, an eleventh transistor T22, a twelfth transistor T21, a thirteenth transistor T6, a second storage capacitor Cbt1, and a third storage capacitor Cbt2. A gate electrode of the tenth transistor T23, a gate electrode of the eleventh transistor T22, and a gate electrode of the twelfth transistor T21 are connected to a first node Q. A first electrode of the tenth transistor T23 is connected to a first clock signal CKa. A second electrode of the tenth transistor T23 is connected to the $n^{th}$ stage transmission signal Count(n). A first electrode of the eleventh transistor T22 is connected to a second clock signal CKb. A second electrode of the eleventh transistor T22 is connected to the first output signal WR(n). A first electrode of the twelfth transistor T21 is connected to a third clock signal CKc. A second electrode of the twelfth transistor T21 is connected to a second output signal RD(n). A gate electrode of the thirteenth transistor T6 is connected to the first node Q. A first electrode of the thirteenth transistor T6 is connected to a fourth node N. A second electrode of the thirteenth transistor T6 is connected to the first output signal WR(n). A first electrode plate of the second storage capacitor Cbt1 is connected to the first node Q. A second electrode plate of the second storage capacitor Cbt1 is connected to the first output signal WR(n). A first electrode plate of the third storage capacitor Cbt2 is connected to the first node Q. A second electrode plate of the third storage capacitor Cbt2 is connected to the second output signal RD(n).

The first pull-down module 400 comprises a fourteenth transistor T33 and a fifteenth transistor T34. A gate electrode of the fourteenth transistor T33 and a gate electrode of the fifteenth transistor T34 are connected to a second input signal VST. A first electrode of the fourteenth transistor T33 is connected to the first node Q. A second electrode of the fourteenth transistor T33 is connected to a first electrode of the fifteenth transistor T34 and a fourth node N. A second electrode of the fifteenth transistor T34 is connected to the first low potential signal VGL1.

The second pull-down module 500 comprises a sixteenth transistor T31, a seventeenth transistor T32 and an eighteenth transistor T55. A gate electrode of the sixteenth transistor T31 and a gate electrode of the seventeenth transistor T32 are connected to a $(n+2)^{th}$ stage transmission signal Count(n+2). A first electrode of the sixteenth transistor T31 is connected to the first node Q. A second electrode of the sixteenth transistor T31 is connected to a first electrode of the seventeenth transistor T32 and the fourth node N. A second electrode of the seventeenth transistor T32 is connected to the first low potential signal VGL1. A gate electrode of the eighteenth transistor T55 is connected to the $(n-2)^{th}$ stage transmission signal Count(n−2). A first electrode of the eighteenth transistor T55 is connected to a second low potential signal VGL2, and the first electrode of eighteenth transistor T55 is connected to the third node QB.

The third pull-down module 600 comprises a nineteenth transistor T102 and a twenty transistor T101. A gate electrode of the nineteenth transistor T102 is connected to the second node. A first electrode of the nineteenth transistor T102 is connected to the second low potential signal VGL2. A second electrode of the nineteenth transistor T102 is connected to a first electrode of the twenty transistor T101. A gate electrode of the twenty transistor T101 is connected to the reset signal Total-Reset. A second electrode of the twenty transistor T101 is connected to the third node QB.

The first pull-down maintenance module 700 comprises a twenty-first transistor T44, a twenty-second transistor T45, a twenty-third transistor T51, a twenty-fourth transistor T52, a twenty-fifth transistor T53, and a twenty-sixth transistor T54. A gate electrode of the twenty-first transistor T44 and a gate electrode of the twenty-second transistor T45 are connected to the third node QB. A first electrode of the twenty-first transistor T44 is connected to the first node Q. A second electrode of the twenty-first transistor T44 is connected to a first electrode of the twenty-second transistor T45 and the fourth node N. A second electrode of the twenty-second transistor T45 is connected to the first low potential signal VGL1. A gate electrode and a first electrode of the twenty-third transistor T51 are connected to the high potential signal VGH. A second electrode of the twenty-third transistor T51 is connected to a first electrode of the twenty-fourth transistor T52. A gate electrode of the twenty-fourth transistor T52 is connected to the first node Q. A second electrode of the twenty-fourth transistor T52 is connected to the second low potential signal VGL2. A gate electrode of the twenty-fifth transistor T53 is connected to the second electrode of the twenty-third transistor T51. A first electrode of the twenty-fifth transistor T53 is connected to the high potential signal VGH. A second electrode of the twenty-fifth transistor T53 is connected to a first electrode of the twenty-sixth transistor T54 and the third node QB. A gate electrode of the twenty-sixth transistor T54 is connected to the first node Q. A second electrode of the twenty-sixth transistor T54 is connected to the second low potential signal VGL2.

The second pull-down maintenance module 800 comprises a twenty-seventh transistor T43, a twenty-eighth transistor T42, and a twenty-ninth transistor T41. A gate electrode of the twenty-seventh transistor T43, a gate electrode of the twenty-eighth transistor T42, and a gate electrode of the twenty-ninth transistor T41 are connected to the third node QB. A first electrode of the twenty-seventh transistor T43 is connected to the first low potential signal VGL1. A second electrode of the twenty-seventh transistor T43 is connected to the $n^{th}$ stage transmission signal Count (n). A first electrode of the twenty-eighth transistor T42 is connected to a third low potential signal VGL3. A second electrode of the twenty-eighth transistor T42 is connected to the first output signal WR(n). A first electrode of the twenty-ninth transistor T41 is connected to the third low potential signal VGL3. A second electrode of the twenty-ninth transistor T41 is connected to the second output signal RD(n).

The GOA circuit of the present invention, comprises a number "m" of GOA units connected in cascade. a stage transmission signal outputted by a nth one of the GOA units is a $n^{th}$ stage transmission signal Count(n), $2 \le n \le m$, and n is an integer. A $(n-2)^{th}$ stage transmission signal Count(n−2) is a stage transmission signal two levels before the $n^{th}$ stage transmission signal Count(n). The $(n+2)^{th}$ stage transmission signal Count(n+2) is a stage transmission signal two levels after the $n^{th}$ stage transmission signal Count(n).

In the GOA circuit of the present invention, the first input signal LSP, the second input signal VST, and the reset signal Total-Reset are provided by an external timer.

Figure 3:
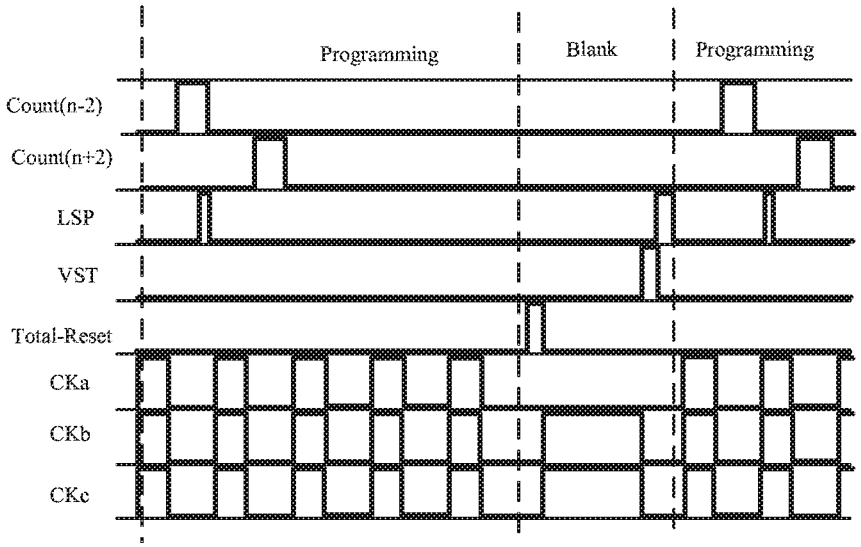
FIG. 3 is a timing chart of signals of the GOA circuit of the embodiment of the present invention in a display time period and a blank time period respectively.

The GOA circuit provided by the embodiment of the present invention is a real-time compensation circuit and requires the GOA to output drive timing display images in a display time period corresponding to each frame, and to output wide pulse timing Vth in a blank time period between adjacent frames for detection of a threshold voltage. FIG. 3 shows a timing chart of signals of the GOA circuit of the embodiment of the present invention in a display time period Programming and a blank time period Blank respectively. Voltage setting values of each signal in a high potential and a low potential respectively are as shown in Table 1.

TABLE 1

| | Voltage setting | |
|---|---|---|
| GOA signal | low potential | high potential |
| Count(n − 2) | −13 | +20 |
| Count(n + 2) | −13 | +20 |
| LSP | −13 | +20 |
| VST | −13 | +20 |
| Total-Reset | −13 | +20 |
| CKa | −13 | +20 |
| CKb | −13 | +20 |
| CKc | −13 | +20 |
| VGH | +20 | |
| VGL1 | −13 | |
| VGL2 | −10 | |
| VGL3 | −6 | |

Figure 4:
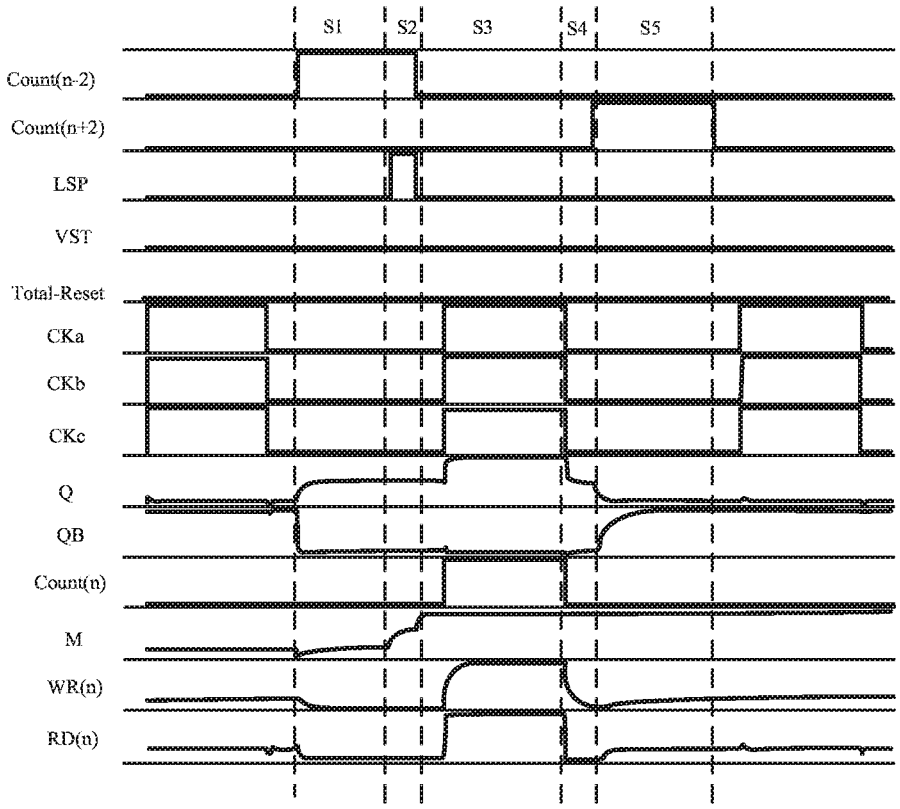
FIG. 4 is a timing chart of each signal of the GOA circuit provided by the embodiment of the present invention in the display time period.
Figure 5:
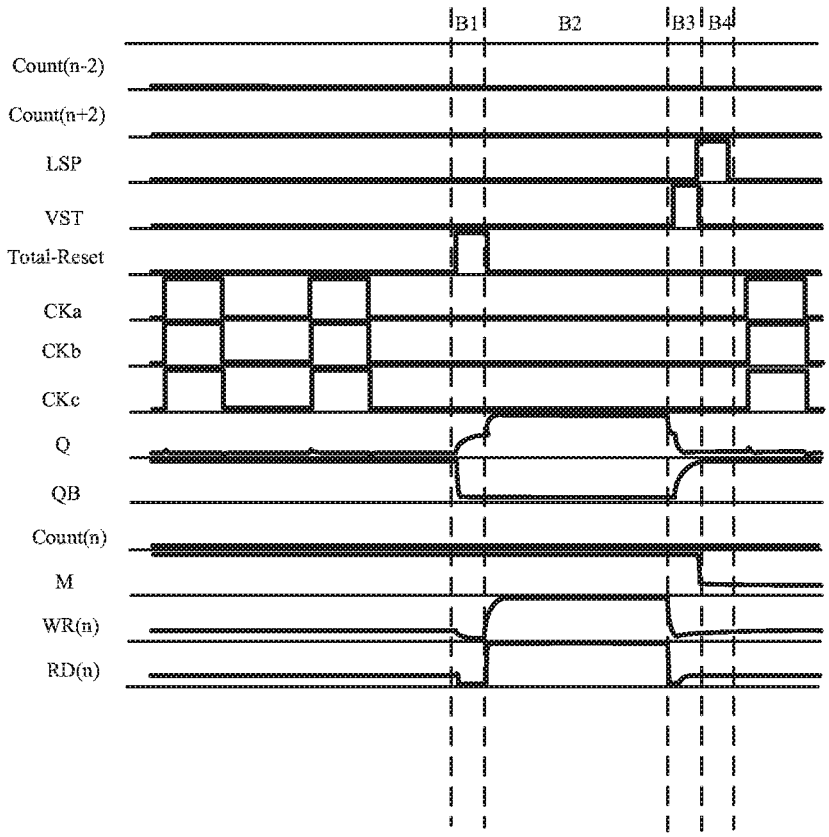
FIG. 5 is a timing chart of each signal of the GOA circuit provided by the embodiment of the present invention in the blank time period.

With reference to FIG. 4 and FIG. 5, the work of the GOA circuit in the display time period and in the blank time period are descried specifically as follows.

With reference to FIG. 4, the display time period comprises a first display stage S1, a second display stage S2, a third display stage S3, a fourth display stage S4, and a fifth display stage S5.

In the first display stage S1, the $(n-2)^{th}$ stage transmission signal Count(n−2) is raised to a high potential, and the first transistor T11 and the second transistor T12 switch on. The first node Q is pulled up to a high potential, and the twenty-fourth transistor T52, the twenty-sixth transistor T54, the tenth transistor T23, the eleventh transistor T22, and the twelfth transistor T21 switch on. Because connection between the first node Q and the third node QB constitutes an inverter structure, potentials thereof are opposite. Therefore, the third node QB are in a low potential, the twenty-seventh transistor T43, the twenty-eighth transistor T42, the twenty-ninth transistor T41, the twenty-first transistor T44 and the twenty-second transistor T45 switch off. In the meantime, the $(n+2)^{th}$ stage transmission signal Count(n+2) is in a low potential, and the sixteenth transistor T31 and the seventeenth transistor T32 switch off. The second input signal VST is in a low potential, and the fourteenth transistor T33 and the fifteenth transistor T34 switch off. A first timing signal CKa, a second timing signal CKb, and a third timing signal CKc are in a low potential, the $n^{th}$ stage transmission signal Count(n), the first output signal WR(n), and the second output signal RD(n) output a low potential. Because the $(n-2)^{th}$ stage transmission signal Count(n−2) is a high potential, the third transistor T91 switches on, a P point connected to the first electrode plate of the first storage capacitor Cbt3 is reset to a low potential, and the second node M connected to the second electrode plate is in a low potential in the meantime.

In the second display stage S2, the first input signal LSP is raised to a high potential. In the meantime, the $(n-2)^{th}$ stage transmission signal Count(n−2) keeps the potential high, the second node M is raised to a high potential, the fourth transistor T92 switches on, and the P point keeps the potential low. Because the reset signal Total-Rest and the second input signal VST are in a low potential, the first node Q keeps the potential high, and the third node QB keeps the potential low.

In the third display stage S3, the first input signal LSP changes from a high potential to a low potential. The fifth transistor T71 and the sixth transistor T72 switch off. The $(n-2)^{th}$ stage transmission signal Count(n−2) changes from a high potential to a low potential. Therefore, the third transistor T91 switches off, the P point potential switches from a low potential to a high potential. Because of existence of the first storage capacitor Cbt3, the second node M receives a coupling effect and is raised to a higher potential. The first timing signal Cka, the second timing signal CKb, and the third timing signal CKc change from a low potential to a high potential. Therefore, potentials of the $n^{th}$ stage transmission signal Count(n), the first output signal WR(n), and the second output signal RD(n) are raised to a high potential. In the meantime, because of existence of the second storage capacitor Cbt1 and the third storage capacitor Cbt2, the first node Q is coupled to a higher potential.

In the fourth display stage S4, the first timing signal Cka, the second timing signal CKb, and the third timing signal CKc switch from a high potential to a low potential. the potentials of the $n^{th}$ stage transmission signal Count(n), the first output signal WR(n), and the second output signal RD(n) are pulled down to a low potential. Signal coupling of the first node Q is lowered and is consistent with the potential in the second display stage S2.

In the fifth display stage S5, the $(n+2)^{th}$ stage transmission signal Count(n+2) is raised from a low potential to a high potential, the sixteenth transistor T31 and the seventeenth transistor T32 switch on. The potential of the first node Q is pulled down to a low potential, and the twenty-fourth transistor T52, the twenty-sixth transistor T54, the tenth transistor T23, the eleventh transistor T22, and the twelfth transistor T21 switch off. The potential of the third node QB is raised to a high potential, and the twenty-seventh transistor T43, the twenty-eighth transistor T42, twenty-ninth transistor T41, the twenty-first transistor T44, and the twenty-second transistor T45 switch on. The first node Q, the $n^{th}$ stage transmission signal Count(n), the first output signal WR(n), and the second output signal RD(n) keep the potentials low.

With reference to FIG. 5, the blank time period comprises a first blank stage B1, a second blank stage B2, a third blank stage B3, and a fourth blank stage B4.

In the first blank stage B1, the reset signal Total reset is raised to a high potential, the ninth transistor T82 switches on, the potential of the first node Q is pulled up to a high potential, and the twenty-fourth transistor T52, the twenty-sixth transistor T54, the tenth transistor T23, the eleventh transistor T22, and the twelfth transistor T21 switch on. Because connection between the first node Q and the third node QB constitutes an inverter structure, potentials thereof are opposite. Therefore, the third node QB are in a low potential, the twenty-seventh transistor T43, the twenty-eighth transistor T42, the twenty-ninth transistor T41, the twenty-first transistor T44 and the twenty-second transistor T45 switch off. In the meantime, the $(n+2)^{th}$ stage transmission signal Count(n+2) is in a low potential, and the sixteenth transistor T31 and the seventeenth transistor T32 switch off. The second input signal VST is in a low potential, and the fourteenth transistor T33 and the fifteenth transistor T34 switch off. A first timing signal CKa, a second timing signal CKb, and a third timing signal CKc are in a low potential, the $n^{th}$ stage transmission signal Count(n), the first output signal WR(n), and the second output signal RD(n) output a low potential.

In the second blank stage B2, the reset signal Total reset is lowered to a low potential, the ninth transistor T82 switches off, and the first timing signal Cka keeps the potential low. The second timing signal CKb and the third timing signal CKc is raised to a high potential, the $n^{th}$ stage transmission signal Count(n) keeps the potential low, and the first output signal WR(n) and the second output signal RD(n) output a high potential. The first node Q is coupled to a higher potential.

In the third blank stage B3, the second input signal VST is raised from a low potential to a high potential, and the fourteenth transistor T33 and the fifteenth transistor T34 switch on. The potential of the first node Q is pulled down to a low potential, and the twenty-fourth transistor T52, the twenty-sixth transistor T54, the tenth transistor T23, the eleventh transistor T22, and the twelfth transistor T21 switch off. The potential of the third node QB is raised to a high potential, and the twenty-seventh transistor T43, the twenty-eighth transistor T42, the twenty-ninth transistor T41, the twenty-first transistor T44, and the twenty-second transistor T45 switch on. The first node Q, the first output signal WR(n), and the second output signal RD(n) are pulled down to a low potential, and the $n^{th}$ stage transmission signal Count(n) keeps the potential low.

In the fourth blank stage B4, the first input signal LSP is raised to a high potential, and the fifth transistor T71 and the sixth transistor T72 switch on. Because the $(n-2)^{th}$ stage transmission signal Count(n−2) is in a low potential, the second node M is reset to a low potential, and the eighth transistor T81 switches off. The first node Q, the $n^{th}$ stage transmission signal Count(n), the first output signal WR(n), and the second output signal RD(n) keep the potentials low.

The GOA circuit provided by the embodiment of the present invention is a real-time compensation GOA circuit, by the above steps provides the scan lines driver signals to drive the display panel to display screen images.

In the above process, by setting the third transistor T91 and the fourth transistor T92 on the side of the first electrode plate of the first storage capacitor Cbt3, in first display stage S1 the third transistor T91 and the fourth transistor T92 switch on such that the P point and the second node M potential are in a low potential, and in the second display stage S2 the third transistor T91 and the fourth transistor T92 switch on, the potential of the P point is kept low, and the potential of the second node M is pulled up first. In the third display stage S3, the third transistor T91 switches off, the fourth transistor T92 switches on, and the potential of the P point is pulled up. Because the coupling effect, the potential of the second node M is pulled up second. Therefore, in the first blank stage B1, the potential of the first node Q is pulled up higher compared to the prior art, and a charge rate is guaranteed such that a threshold voltage margin available for the GOA circuit increases, which improves stability of the GOA circuit and lowers difficulty of development of the transistor process.

Figure 6:
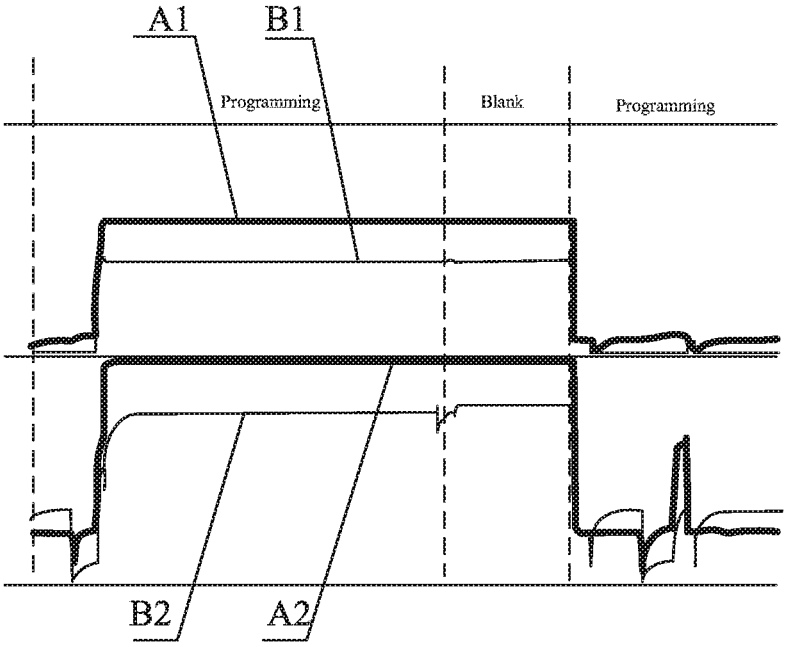
FIG. 6 is a schematic effect comparison chart of an overall shift of a threshold voltage to a potential of a second node in each of the GOA circuit of the present invention and the conventional GOA circuit.

With reference to FIG. 6 is a schematic effect comparison chart of an overall shift of a threshold voltage to a potential of a second node M in each of the GOA circuit of the present invention and the conventional GOA circuit. A first curve A1 is a potential of the second node M waveform in the prior art when a threshold voltage is 0, a second curve A2 is a potential of the second node M waveform of the present invention when a threshold voltage is 0, a third curve B1 is a potential waveform of the second node M in the prior art when a threshold voltage is 5V. A fourth curve B2 is a potential waveform of the second node M of the present invention when a threshold voltage is 5V.

Figure 7:
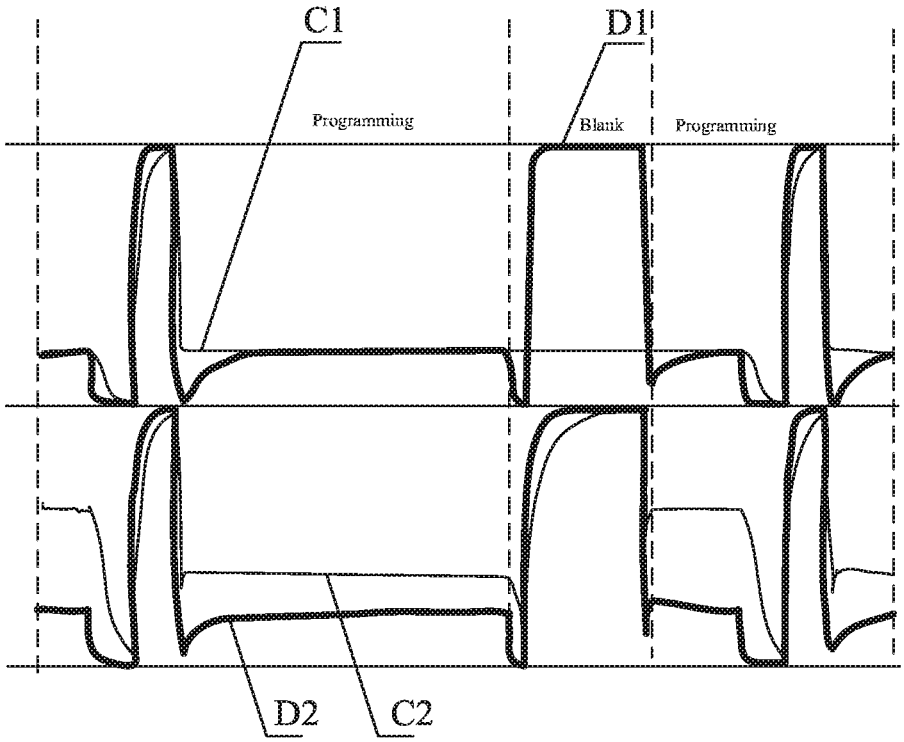
FIG. 7 is a schematic effect comparison chart of an overall shift of a threshold voltage to a first output signal in each of the GOA circuit of the present invention and the conventional GOA circuit.

With reference to FIG. 7, FIG. 7 is a schematic effect comparison chart of an overall shift of a threshold voltage to a first output signal WR(n) in each of the GOA circuit of the present invention and the conventional GOA circuit. A fifth curve C1 is a potential waveform of the first output signal WR(n) in the prior art when a threshold voltage is 0, a sixth curve C2 is a potential waveform of the first output signal WR(n) of the present invention when a threshold voltage is 0, a seventh curve D1 is a potential waveform of the first output signal WR(n) in the prior art when a threshold voltage is 5V, an eighth curve D2 is a potential waveform of the first output signal WR(n) of the present invention when a threshold voltage is 5V.

With reference to FIGS. 6 and 7, when the threshold voltage Vth is 5V, in the display time period, the potential of the second node M of the conventional GOA circuit is lower, and the potential of the second node M of the present invention is still higher. In the blank time period, the conventional GOA circuit outputs no waveform, the circuit completely fails, the first output signal WR(n) of the present invention still has output, and the GOA circuit works normally. Therefore, the GOA circuit of the present invention, compared to the prior art, by pulling up the potential of the second node twice in the display time period, increases the potential of the first node in the blank time period and guarantees a charge rate such that a margin of a threshold voltage available for the GOA circuit to improve stability of the GOA circuit and lower developing difficulty for a transistor process.

The present invention also provides a display panel comprising the GOA circuit of any one of the above embodiment.

According to the Embodiments

The present invention provides the GOA circuit and the display panel, the GOA circuit comprises a number "m" of GOA units connected in cascade. A nth one of the GOA units comprises a pull-up control module, a logical addressing module, a pull-up module, a first pull-down module, a second pull-down module, a third pull-down module, a first pull-down maintenance module, and a second pull-down maintenance module. The pull-up control module is connected to a first node and is configured to pull up a potential of the first node in a display time period. The logical addressing module comprises a second node, the logical addressing module is connected to the first node, is configured to, pull up the second node potential twice in the display time period, and is configured to pull up the potential of the first node through the second node in a blank time period. The pull-up module is connected to the first node and is configured to pull up a potential of a $n^{th}$ stage transmission signal, a potential of a first output signal, and a potential of a second output signal. The first pull-down module is connected to the first node and is configured to pull down the potential of the first node in the blank time period. The second pull-down module is connected to the first node and a third node and is configured to pull down the potential of the first node and a potential of the third node in the display time period. The third pull-down module is connected to the third node and the second pull-down module and is configured to pull down the potential of the third node in the blank time period. The first pull-down maintenance module comprises the third node, is connected to the first node and the first pull-down module, and is configured to keep the potential of the first node low. The second pull-down maintenance module is connected to the third node and the pull-up module and is configured to keep the potential of the $n^{th}$ stage transmission signal, the potential of the first output signal, and the potential of the second output signal low. By pulling up the potential of the second node twice in the display time period, the potential of the first node is increased in the blank time period and a charge rate is guaranteed such that a margin of a threshold voltage available for the GOA circuit to improve stability of the GOA circuit and lower developing difficulty for a transistor process.

Although the preferred embodiments of the present invention have been disclosed as above, the aforementioned preferred embodiments are not used to limit the present invention. The person of ordinary skill in the art may make various changes and modifications without departing from the spirit and scope of the present invention. Therefore, the scope of protection of the present invention is defined by the scope of the claims.

What is claimed is:

1. A gate driver on array (GOA) circuit, comprising a number "m" of GOA units connected in cascade, wherein a $n^{th}$ one of the GOA units comprises:

a pull-up control module connected to a first node and configured to pull up a potential of the first node in a display time period;

a logical addressing module comprising a second node, connected to the first node, and configured to pull up a potential of the second node twice in the display time period and to pull up the potential of the first node through the second node in a blank time period;

a pull-up module connected to the first node, configured to pull up a potential of a $n^{th}$ stage transmission signal, a potential of a first output signal, and a potential of a second output signal;

a first pull-down module connected to the first node, and configured to pull down the potential of the first node in the blank time period;

a second pull-down module connected to the first node and a third node and configured to pull down the potential of the first node and a potential of the third node in the display time period;

a third pull-down module connected to the third node and the second pull-down module and configured to pull down the potential of the third node in the blank time period;

a first pull-down maintenance module comprising the third node, connected to the first node and the first pull-down module, and configured to keep the potential of the first node low; and a second pull-down maintenance module connected to the third node and the pull-up module and configured to keep the potential of the $n^{th}$ stage transmission signal, the potential of the first output signal, and the potential of the second output signal low.

2. The GOA circuit as claimed in claim 1, wherein the pull-up control module comprises a first transistor and a second transistor, a gate electrode and a first electrode of the first transistor and a gate electrode of the second transistor are connected to a $(n-2)^{th}$ stage transmission signal, a second electrode of the first transistor is connected to a first electrode of the second transistor and a fourth node, and a second electrode of the second transistor is connected to the first node.

3. The GOA circuit as claimed in claim 2, wherein the logical addressing module comprises a third transistor, a fourth transistor, a fifth transistor, a sixth transistor, a seventh transistor, an eighth transistor, a ninth transistor, and a first storage capacitor, a gate electrode of the third transistor is connected to the $(n-2)^{th}$ stage transmission signal, a first electrode of the third transistor is connected to a first low potential signal, a second electrode of the third transistor is connected to a first electrode of the fourth transistor, a gate electrode and a second electrode of the fourth transistor are connected to a high potential signal, a gate electrode of the fifth transistor is connected to a first input signal, a first electrode of the fifth transistor is connected to the $(n-2)^{th}$ stage transmission signal, a second electrode of the fifth transistor is connected to a first electrode of the sixth transistor and a first electrode of the seventh transistor, a gate electrode of the sixth transistor is connected to the first input signal, a second electrode of the sixth transistor and a gate electrode of the seventh transistor are connected to the second node, a second electrode of the seventh transistor is connected to the high potential signal, a gate electrode of the eighth transistor is connected to the second node, a first electrode of the eighth transistor is connected to the high potential signal, a second electrode of the eighth transistor is connected to a first electrode of the ninth transistor, a gate electrode of the ninth transistor is connected to a reset signal, a second electrode of the ninth transistor is connected to the first node, a first electrode plate of the first storage capacitor is connected to the second electrode of the third transistor, and a second electrode plate of the first storage capacitor is connected to the second node.

4. The GOA circuit as claimed in claim 3, wherein the pull-up module comprises a tenth transistor, an eleventh transistor, a twelfth transistor, a thirteenth transistor, a second storage capacitor, and a third storage capacitor, a gate electrode of the tenth transistor, a gate electrode of the eleventh transistor, and a gate electrode of the twelfth transistor are connected to the first node, a first electrode of the tenth transistor is connected to a first clock signal, a second electrode of the tenth transistor is connected to the $n^{th}$ stage transmission signal, a first electrode of the eleventh transistor is connected to a second clock signal, a second electrode of the eleventh transistor is connected to the first output signal, a first electrode of the twelfth transistor is connected to a third clock signal, a second electrode of the twelfth transistor is connected to the second output signal, a gate electrode of the thirteenth transistor is connected to the first node, a first electrode of the thirteenth transistor is connected to the fourth node, a second electrode of the thirteenth transistor is connected to the first output signal, a first electrode plate of the second storage capacitor is connected to the first node, a second electrode plate of the second storage capacitor is connected to the first output signal, a first electrode plate of the third storage capacitor is connected to the first node, and a second electrode plate of the third storage capacitor is connected to the second output signal.

5. The GOA circuit as claimed in claim 4, wherein the first pull-down module comprises a fourteenth transistor and a fifteenth transistor, a gate electrode of the fourteenth transistor and a gate electrode of the fifteenth transistor are connected to a second input signal, a first electrode of the fourteenth transistor is connected to the first node, a second electrode of the fourteenth transistor is connected to a first electrode of the fifteenth transistor and the fourth node, and a second electrode of the fifteenth transistor is connected to the first low potential signal.

6. The GOA circuit as claimed in claim 5, wherein the second pull-down module comprises a sixteenth transistor, a seventeenth transistor, and an eighteenth transistor, a gate electrode of the sixteenth transistor and a gate electrode of the seventeenth transistor are connected to a $(n+2)^{th}$ stage transmission signal, a first electrode of the sixteenth transistor is connected to the first node, a second electrode of the sixteenth transistor is connected to a first electrode of the seventeenth transistor and the fourth node, a second electrode of the seventeenth transistor is connected to the first low potential signal, a gate electrode of the eighteenth transistor is connected to the $(n-2)^{th}$ stage transmission signal, a first electrode of the eighteenth transistor is connected to the second low potential signal, and the first electrode of the eighteenth transistor is connected to the third node.

7. The GOA circuit as claimed in claim 6, wherein the third pull-down module comprises a nineteenth transistor and a twenty transistor, a gate electrode of the nineteenth transistor is connected to the second node, a first electrode of the nineteenth transistor is connected to the second low potential signal, a second electrode of the nineteenth transistor is connected to the twenty transistor first electrode, a gate electrode of the twenty transistor is connected to the reset signal, and a second electrode of the twenty transistor is connected to the third node.

8. The GOA circuit as claimed in claim 7, wherein the first pull-down maintenance module comprises a twenty-first transistor, a twenty-second transistor, a twenty-third transistor, a twenty-fourth transistor, a twenty-fifth transistor, and a twenty-sixth transistor, a gate electrode of the twenty-first transistor and a gate electrode of the twenty-second transistor are connected to the third node, a first electrode of the twenty-first transistor is connected to the first node, a second electrode of the twenty-first transistor is connected to a first electrode of the twenty-second transistor and the fourth node, a second electrode of the twenty-second transistor is connected to the first low potential signal, a gate electrode and a first electrode of the twenty-third transistor are connected to the high potential signal, a second electrode of the twenty-third transistor is connected to a first electrode of the twenty-fourth transistor, a gate electrode of the twenty-fourth transistor is connected to the first node, a second electrode of the twenty-fourth transistor is connected to the second low potential signal, a gate electrode of the twenty-fifth transistor is connected to a second electrode of the twenty-third transistor, a first electrode of the twenty-fifth transistor is connected to the high potential signal, a second electrode of the twenty-fifth transistor is connected to a first electrode of the twenty-sixth transistor and the third node, a gate electrode of the twenty-sixth transistor is connected to the first node, and a second electrode of the twenty-sixth transistor is connected to the second low potential signal.

9. The GOA circuit as claimed in claim 8, wherein the second pull-down maintenance module comprises a twenty-seventh transistor, a twenty-eighth transistor, and a twenty-ninth transistor, a gate electrode of the twenty-seventh transistor, a gate electrode of the twenty-eighth transistor, and a gate electrode of the twenty-ninth transistor are connected to the third node, a first electrode of the twenty-seventh transistor is connected to the first low potential signal, a second electrode of the twenty-seventh transistor is connected to the $n^{th}$ stage transmission signal, a first electrode of the twenty-eighth transistor is connected to a third low potential signal, a second electrode of the twenty-eighth transistor is connected to the first output signal, a first electrode of the twenty-ninth transistor is connected to the third low potential signal, and a second electrode of the twenty-ninth transistor is connected to the second output signal.

10. The GOA circuit as claimed in claim 9, wherein the first input signal, the second input signal and the reset signal are provided by an external timer.

11. A display panel, comprising a gate driver on array (GOA) circuit, the GOA circuit comprising a number "m" of GOA units connected in cascade, wherein a $n^{th}$ one of the GOA units comprises:

a pull-up control module connected to a first node and configured to pull up a potential of the first node in a display time period;

a logical addressing module comprising a second node, connected to the first node, and configured to pull up a potential of the second node twice in the display time period and to pull up the potential of the first node through the second node in a blank time period;

a pull-up module connected to the first node, configured to pull up a potential of a $n^{th}$ stage transmission signal, a potential of a first output signal, and a potential of a second output signal;

a first pull-down module connected to the first node, and configured to pull down the potential of the first node in the blank time period;

a second pull-down module connected to the first node and a third node and configured to pull down the potential of the first node and a potential of the third node in the display time period;

a third pull-down module connected to the third node and the second pull-down module, and configured to pull down the potential of the third node in the blank time period;

a first pull-down maintenance module comprising the third node, connected to the first node and the first pull-down module, and configured to keep the potential of the first node low; and a second pull-down maintenance module connected to the third node and the pull-up module and configured to keep the potential of the $n^{th}$ stage transmission signal, the potential of the first output signal, and the potential of the second output signal low.

12. The display panel as claimed in claim 11, wherein the pull-up control module comprises a first transistor and a second transistor, a gate electrode and a first electrode of the first transistor and a gate electrode of the second transistor are connected to a $(n-2)^{th}$ stage transmission signal, a second electrode of the first transistor is connected to a first electrode of the second transistor and a fourth node, and a second electrode of the second transistor is connected to the first node.

13. The display panel as claimed in claim 12, wherein the logical addressing module comprises a third transistor, a fourth transistor, a fifth transistor, a sixth transistor, a seventh transistor, an eighth transistor, a ninth transistor, and a first storage capacitor, a gate electrode of the third transistor is connected to the $(n-2)^{th}$ stage transmission signal, a first electrode of the third transistor is connected to a first low potential signal, a second electrode of the third transistor is connected to a first electrode of the fourth transistor, a gate electrode and a second electrode of the fourth transistor are connected to a high potential signal, a gate electrode of the fifth transistor is connected to a first input signal, a first electrode of the fifth transistor is connected to the $(n-2)^{th}$ stage transmission signal, a second electrode of the fifth transistor is connected to a first electrode of the sixth transistor and a first electrode of the seventh transistor, a gate electrode of the sixth transistor is connected to the first input signal, a second electrode of the sixth transistor and a gate electrode of the seventh transistor are connected to the second node, a second electrode of the seventh transistor is connected to the high potential signal, a gate electrode of the eighth transistor is connected to the second node, a first electrode of the eighth transistor is connected to the high potential signal, a second electrode of the eighth transistor is connected to a first electrode of the ninth transistor, a gate electrode of the ninth transistor is connected to a reset signal, a second electrode of the ninth transistor is connected to the first node, a first electrode plate of the first storage capacitor is connected to the second electrode of the third transistor, and a second electrode plate of the first storage capacitor is connected to the second node.

14. The display panel as claimed in claim 13, wherein the pull-up module comprises a tenth transistor, an eleventh transistor, a twelfth transistor, a thirteenth transistor, a second storage capacitor, and a third storage capacitor, a gate electrode of the tenth transistor, a gate electrode of the eleventh transistor, and a gate electrode of the twelfth transistor are connected to the first node, a first electrode of the tenth transistor is connected to a first clock signal, a second electrode of the tenth transistor is connected to the $n^{th}$ stage transmission signal, a first electrode of the eleventh transistor is connected to a second clock signal, a second electrode of the eleventh transistor is connected to the first output signal, a first electrode of the twelfth transistor is connected to a third clock signal, a second electrode of the twelfth transistor is connected to the second output signal, a gate electrode of the thirteenth transistor is connected to the first node, a first electrode of the thirteenth transistor is connected to the fourth node, a second electrode of the thirteenth transistor is connected to the first output signal, a first electrode plate of the second storage capacitor is connected to the first node, a second electrode plate of the second storage capacitor is connected to the first output signal, a first electrode plate of the third storage capacitor is connected to the first node, and a second electrode plate of the third storage capacitor is connected to the second output signal.

15. The display panel as claimed in claim 14, wherein the first pull-down module comprises a fourteenth transistor and a fifteenth transistor, a gate electrode of the fourteenth transistor and a gate electrode of the fifteenth transistor are connected to a second input signal, a first electrode of the fourteenth transistor is connected to the first node, a second electrode of the fourteenth transistor is connected to a first electrode of the fifteenth transistor and the fourth node, and a second electrode of the fifteenth transistor is connected to the first low potential signal.

16. The display panel as claimed in claim 15, wherein the second pull-down module comprises a sixteenth transistor, a seventeenth transistor, and an eighteenth transistor, a gate electrode of the sixteenth transistor and a gate electrode of the seventeenth transistor are connected to a $(n+2)^{th}$ stage transmission signal, a first electrode of the sixteenth transistor is connected to the first node, a second electrode of the sixteenth transistor is connected to a first electrode of the seventeenth transistor and the fourth node, a second electrode of the seventeenth transistor is connected to the first low potential signal, a gate electrode of the eighteenth transistor is connected to the $(n-2)^{th}$ stage transmission signal, a first electrode of the eighteenth transistor is connected to the second low potential signal, and the first electrode of the eighteenth transistor is connected to the third node.

17. The display panel as claimed in claim 16, wherein the third pull-down module comprises a nineteenth transistor and a twenty transistor, a gate electrode of the nineteenth transistor is connected to the second node, a first electrode of the nineteenth transistor is connected to the second low potential signal, a second electrode of the nineteenth transistor is connected to the twenty transistor first electrode, a gate electrode of the twenty transistor is connected to the reset signal, and a second electrode of the twenty transistor is connected to the third node.

18. The display panel as claimed in claim 17, wherein the first pull-down maintenance module comprises a twenty-first transistor, a twenty-second transistor, a twenty-third transistor, a twenty-fourth transistor, a twenty-fifth transistor, and a twenty-sixth transistor, a gate electrode of the twenty-first transistor and a gate electrode of the twenty-second transistor are connected to the third node, a first electrode of the twenty-first transistor is connected to the first node, a second electrode of the twenty-first transistor is connected to a first electrode of the twenty-second transistor and the fourth node, a second electrode of the twenty-second transistor is connected to the first low potential signal, a gate electrode and a first electrode of the twenty-third transistor are connected to the high potential signal, a second electrode of the twenty-third transistor is connected to a first electrode of the twenty-fourth transistor, a gate electrode of the twenty-fourth transistor is connected to the first node, a second electrode of the twenty-fourth transistor is connected to the second low potential signal, a gate electrode of the twenty-fifth transistor is connected to a second electrode of the twenty-third transistor, a first electrode of the twenty-fifth transistor is connected to the high potential signal, a second electrode of the twenty-fifth transistor is connected to a first electrode of the twenty-sixth transistor and the third node, a gate electrode of the twenty-sixth transistor is connected to the first node, and a second electrode of the twenty-sixth transistor is connected to the second low potential signal.

19. The display panel as claimed in claim 18, wherein the second pull-down maintenance module comprises a twenty-seventh transistor, a twenty-eighth transistor, and a twenty-ninth transistor, a gate electrode of the twenty-seventh transistor, a gate electrode of the twenty-eighth transistor, and a gate electrode of the twenty-ninth transistor are connected to the third node, a first electrode of the twenty-seventh transistor is connected to the first low potential signal, a second electrode of the twenty-seventh transistor is connected to the $n^{th}$ stage transmission signal, a first electrode of the twenty-eighth transistor is connected to a third low potential signal, a second electrode of the twenty-eighth transistor is connected to the first output signal, a first electrode of the twenty-ninth transistor is connected to the third low potential signal, and a second electrode of the twenty-ninth transistor is connected to the second output signal.

20. The display panel as claimed in claim 19, wherein the first input signal, the second input signal and the reset signal are provided by an external timer.

* * * * *